United States Patent [19]

Zhestkov et al.

[11] 4,301,574

[45] Nov. 24, 1981

[54] SLIVER CONDENSER FOR OPEN-END SPINNING MACHINES

[76] Inventors: Vitaly I. Zhestkov, Chilanzar, kvartal 19, 26, kv. 41; Gennady N. Shlykov, Chilanzar, kvartal 19, 31, kv. 3; Vasily M. Dyachkov, Chilanzar, kvartal 7, 18"V", kv. 8; Valentin N. Tikhonov, ulitsa Sh.Rustavelli, 55, kv. 28; Abdurakhim Abduganiev, Chilanzar, kvartal 20, 33, kv. 7, all of Tashkent, U.S.S.R.

[21] Appl. No.: 96,242

[22] Filed: Nov. 20, 1979

[51] Int. Cl.[3] ..... D01H 5/72

[52] U.S. Cl. ..... 19/288

[58] Field of Search ..... 19/288, 289, 290, 291, 19/292

[56] References Cited

U.S. PATENT DOCUMENTS

| | | | |
|---|---|---|---|
| 2,206,232 | 7/1940 | Martin | 19/288 |
| 2,755,514 | 7/1956 | Noguera | 19/291 |
| 3,895,417 | 7/1975 | Zimmermann | 19/288 |
| 3,947,923 | 4/1976 | Schroder | 19/288 |

FOREIGN PATENT DOCUMENTS 2359176 5/1974 Fed. Rep. of Germany .

*Primary Examiner*—Louis Rimrodt

*Attorney, Agent, or Firm*—Burgess, Ryan & Wayne

[57] ABSTRACT

The invention relates to sliver condensers and may be most advantageously used in mechanopneumatic spinning machines. The sliver condenser has a casing provided with a passage which narrows in the direction of sliver flow. Opposite projections are internally provided over the entire length of the passage to extend at an angle to the longitudinal axis of the passage, the projections crossing one another.

5 Claims, 9 Drawing Figures

SLIVER CONDENSER FOR OPEN-END SPINNING MACHINES

FIELD OF THE ART

The present invention relates to open-end spinning machines, and more specifically, to fibrous sliver condensers to be used in such machines.

This invention may be most advantageously used for mechanopneumatic spinning machines where the main working element is a spinning chamber to which separated fiber is fed.

BACKGROUND OF THE INVENTION

It is known that one of the factors affecting quality of spinning, in particular the evenness, is uniform feeding of separated fiber to the spinning chamber. Such uniform feeding may be achieved, e.g., by uniformly distributing fiber over the cross-section of sliver when it is fed to a separating apparatus (carding arrangement or a drawing apparatus).

Slit-shaped condensers of various designs are used for uniformly distributing fiber over the sliver.

Thus known in the art are condensers installed upstream a drawing apparatus (cf. U.S. Pat. No. 3,947,923, Cl. 19-288, Apr. 6, 1976). The condenser is shaped as a triangle having inside thereof members forming a vertical slit enabling the movement of sliver (roving) downwards when moving along thicker portions. The movement of roving is limited by means of a bridge. The sliver can take any arbitrary position within the condenser.

Such movement of sliver is that is its movement under gravity results, however, in that the sliver tends to gather into a bunch, thickening in the middle of the condenser, whereby the sliver is not uniformly fed to the drawing apparatus, and the drawing quality is inadequate.

More uniform distribution of fiber in sliver may be ensured by using a known condenser (cf. German Offenlegungsschrift No. 2359176, May 30, 1974). This condenser has a casing accommodating a passage for sliver which narrows in the direction of sliver movement. At the sliver outlet side, the passage terminates in a rectangular opening, and the passage is internally provided with opposite projections extending at an angle to the longitudinal axis of the passage.

The provision of the opposite projections enables uniform distribution of fiber over the sliver since such projections engage the sliver to press out surplus fiber (bunches) from the middle of the sliver to its lateral portions.

In case, however, the structure of a sliver is such that maximum quantity of fiber is at the edges thereof and minimum quantity is in the middle portion, the prior art projections fail to provide uniform distribution of fiber over the entire cross-section of sliver.

SUMMARY OF THE INVENTION

It is an object of the invention to provide a sliver condenser which ensures uniform distribution of fiber over the entire cross-section of sliver.

An important object of the invention is to improve the quality of the yarn.

These and other objects are accomplished in a sliver condenser having a casing provided with a passage which narrows in the direction of sliver flow and terminates in a rectangular opening, the passage being internally provided with opposite projections extending at an angle to the longitudinal axis of the passage, according to the invention, each projection extends over the entire length of the passage on either side of its longitudinal axis and the opposite projections cross one another.

The provision of the projections extending over the entire length of the passage and intercrossing of the projections provides uniform density of fiber over the entire cross-section of sliver since one fin displaces surplus quantity of fiber toward one edge of the sliver and the other fin which extends in the opposite direction, displaces the surplus quantity of fiber toward the other edge of the sliver.

For a simpler manufacture, each projection is made in the form of a step.

To maintain intact the sliver structure in the middle portion thereof, as well as to avoid breaking of formed flow of fiber at the sliver outlet from the condenser passage, the projections inside the passage are preferably arranged in such a manner that the distance therebetween on the side of the sliver outlet from the passage is equal to the maximum cross-sectional dimension of the outlet opening of the passage.

To improve the degree of action on thicker portions of sliver in the inlet and working zones, the projections are preferably arranged inside the passage in such a manner that the distance therebetween on the side of sliver entrance to the passage is from 0.4 to 1.0 of the maximum cross-sectional dimension of the passage. The distance *2a*, equal to 0.4, in selected in case of processing an ordinary sliver in the condenser, that is a sliver having a lenticular cross-sectional shape. In such application, the main mass of fiber is in the middle of the sliver, and most intense action of the projections eliminating thicker portions which are displaced toward the edges, occurs in the central part of the sliver.

The distance *2a* equal to 1.0 is used in applications where the condenser is used for a sliver having enlarged edge portions, that is an intense action of the projections for eliminating thicker portions at the edges and displacing them to the middle, occurs at the sliver edges.

The condenser according to the invention is preferably used in a drawing apparatus having a feeder device comprising a sliver clamping line arranged at an angle to the flat side of sliver. In such case, the distance as measured on the side of the inter opening of the passage between the surface provided with the projections is greater than the maximum dimension of the outlet opening of the passage.

BRIEF DESCRIPTION OF THE DRAWINGS

A better understanding of the invention may be had from the following specific embodiments described with reference to the accompanying drawings, in which.

DETAILED DESCRIPTION OF THE INVENTION

Figure 1:
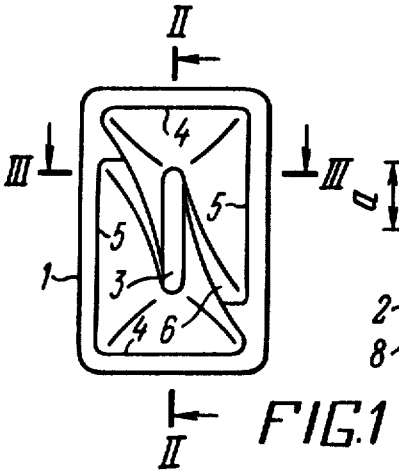
FIG. 1 shows the condenser according to the invention as seen from the inlet opening of the passage.
Figure 2:
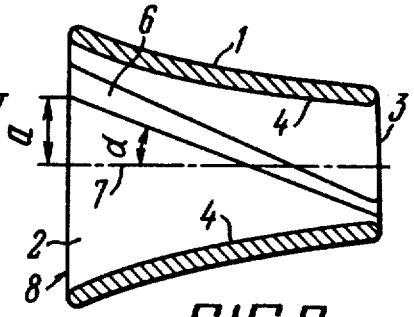
FIG. 2 is a sectional view taken along the line II—II in FIG. 1.

The sliver condenser according to the invention has a casing 1 (FIG. 1) having inside thereof a passage 2 (FIG. 2) which narrows in the direction of sliver flow and terminates in a rectangular opening 3 (FIG. 1). The passage 2 is defined by a pair of walls 4 and 5 of which the walls 5 are wider than the walls 4.

Figure 3:
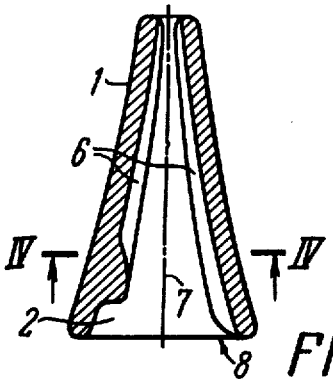
FIG. 3 is a sectional view taken along the line III—III in FIG. 1.
Figure 4:
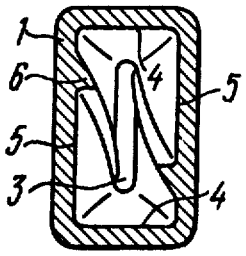
FIG. 4 is a sectional view taken along the line IV—IV in FIG. 3.

The passage 2 is internally provided with opposite projections 6 which are made on the wider walls 5. The projections extend at an angle "α" to the longitudinal axis 7 of the passage 2 and cross one another, that is they extend in the opposite directions as can be seen in FIGS. 1, 3 and 4. Such arrangement of the projections enables elimination of fiber bunches by drawing fiber apart in the sliver in opposite directions, thereby ensuring evening of the sliver over the entire cross-section.

The projections 6 (FIG. 2) are arranged within the passage 2 in such a manner that the distance 2*a* therebetween (a is the distance from one projection to the longitudinal axis 7 of the passage) on the side of entrance of sliver to the passage 2 is from 0.4 to 1.0 of the maximum cross-sectional dimension of the inlet opening 8 of the passage.

The distance 2*a* is equal to 0.4 of the maximum dimension in an application where an ordinary sliver that is, a sliver of a lenticular cross-sectional shape is fed to the sliver condenser, and the distance 2*a* is equal to 1.0 maximum dimension in an application where a sliver with enlarged edges is fed to the sliver condenser.

Figure 5:
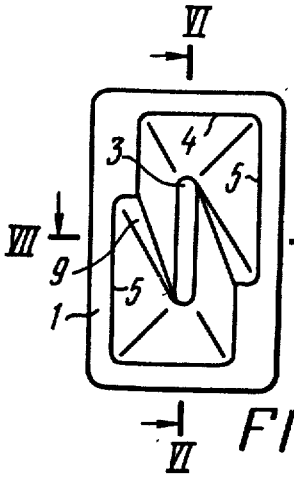
FIG. 5 is another embodiment of the condenser according to the invention.
Figure 6:
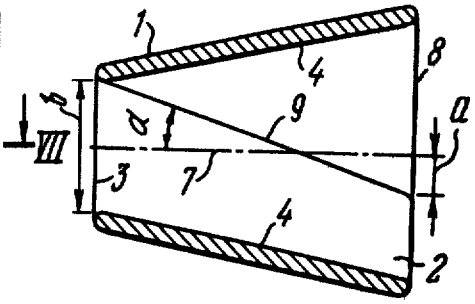
FIG. 6 is a sectional view taken along the line VI—VI in FIG. 5.
Figure 7:
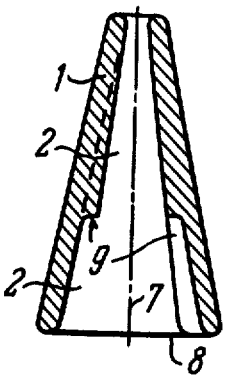
FIG. 7 is a sectional view taken along the line VII—VII in FIG. 5.

FIGS. 5 and 7 show an embodiment of the sliver condenser in which each of the opposite projections thereof is formed as a step 9. The steps also extend at an angle "α" to the longitudinal axis 7 of the passage 2 (FIG. 6) and are arranged within the passage in such a manner that the distance "b" therebetween on the side of the sliver outlet from the passage 2 is equal to the maximum cross-sectional dimension of the outlet opening 3 of the passage.

The sliver condenser functions in the following manner.

Figure 8:
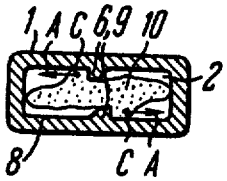
FIG. 8 is a transverse section of the condenser.

A sliver 10 (FIG. 8) is inserted into the sliver condenser on the side of the inlet opening 8 of the passage 2, passes along this narrowing passage and leaves in the condenser state through the rectangular slit-shaped opening 3. When passing through the passage, the enlarged portions "c" of the sliver 10 are engaged by the projections 6,9 and are displaced thereby in opposite directions as shown by arrows "A" in the drawings.

This ensures a uniform distribution of fiber over the entire cross-section of the sliver at the outlet of the sliver condenser, thus contributing to a high degree of separation of fiber, hence, improved quality of the resultant yarn.

It is well known that sliver in cans or spools takes a flat shape under pressure.

Figure 9:
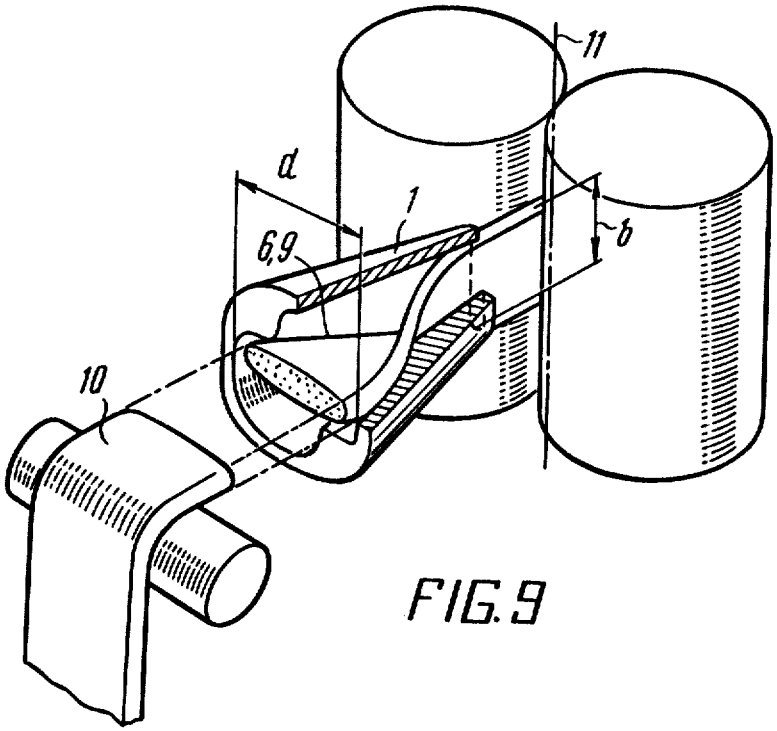
FIG. 9 is the condenser according to the invention used in a drawing apparatus.

On the other hand, known in the art are separating and drawing apparatus having a sliver clamping line 11 in their feed pairs of rolls as shown in FIG. 9 which extends at an angle to the flat side of the sliver 10.

In such a case, the sliver is fed to the clamp with its narrow side and its distributed along the line of clamp in the form of a bunch of an arbitrary configuration.

For a better separation of fiber, hence for improving quality of yarn, the flat side of the sliver is preferably oriented along the clamp line. This is achieved by using the sliver condenser according to the invention.

As shown in FIG. 9, the sliver 10 is fed to the entrance portion of the sliver condenser in such a manner that its edges are between the walls having the steps 6, 9 with a dimension "d". When the sliver moves, the steps act more strongly on its edges to turn the sliver in such a manner that its flat part is oriented along the maximum dimension "b" of the outlet opening, that is along the clamp line of the fiber by the feed pair of rolls. In order that the sliver cannot be damaged at the edges due to an abrupt narrowing, the distance "d" between the walls on which the projections are provided is preferably greater than the maximum cross-sectional dimension "b" of the outlet opening of the sliver condenser.

What we claim is:

1. A sliver condenser for open-end spinning machines, comprising: a casing; a passage arranged within said casing and narrowing in the direction of flow of sliver which extends in said passage; an outlet opening of said passage which is of rectangular shape; projections extending over the entire length of said passage opposite to one another and at an angle to the longitudinal axis of the passage, said projections crossing one another.

2. A sliver condenser as claimed in claim 1, wherein each projection is formed as a step.

3. A sliver condenser as claimed in claim 1, wherein the projections are arranged inside the passage in such a manner that the distance therebetween on the side of the sliver outlet from the passage is equal to the maximum cross-sectional dimension of the outlet opening of the passage.

4. A sliver condenser as claimed in claim 1, wherein the projections are arranged inside the passage in such a manner that the distance therebetween on the side of entrance of the sliver to the passage is equal to from 0.4 to 1.0 of the maximum cross-sectional dimension of the inlet opening of the passage.

5. The use of the sliver condenser as claimed in claim 1 for a drawing apparatus, wherein a sliver clamping line extends at an angle to the flat side of the sliver, wherein the distance as measured on the side of the inlet opening of the passage between the surfaces on which the projections are provided is greater than the maximum dimension of the outlet opening of the passage.

* * * * *